US010596413B2

(12) United States Patent
Zerbo et al.

(10) Patent No.: US 10,596,413 B2
(45) Date of Patent: Mar. 24, 2020

(54) MULTI-FUNCTIONAL FINGER EXERCISE DEVICE

(71) Applicant: D'Addario & Company, Inc., Farmingdale, NY (US)

(72) Inventors: Patrick Zerbo, Cold Spring Harbor, NY (US); Andrzej J. Krol, Wayne, NJ (US)

(73) Assignee: D'Addario & Company, Inc., Farmingdale, NY (US)

( * ) Notice: Subject to any disclaimer, the term of this patent is extended or adjusted under 35 U.S.C. 154(b) by 97 days.

(21) Appl. No.: 15/983,432

(22) Filed: May 18, 2018

(65) Prior Publication Data

US 2018/0333609 A1 Nov. 22, 2018

Related U.S. Application Data

(60) Provisional application No. 62/508,410, filed on May 19, 2017.

(51) Int. Cl.

| | |
|---|---|
| ***A63B 23/16*** | (2006.01) |
| ***A63B 21/00*** | (2006.01) |
| ***A63B 21/05*** | (2006.01) |
| ***A63B 21/02*** | (2006.01) |
| ***A63B 21/04*** | (2006.01) |
| ***A63B 21/055*** | (2006.01) |
| ***A63B 23/00*** | (2006.01) |

(52) U.S. Cl.

CPC ..... *A63B 23/16* (2013.01); *A63B 21/00069* (2013.01); *A63B 21/023* (2013.01); *A63B 21/0428* (2013.01); *A63B 21/05* (2013.01); *A63B 21/0552* (2013.01); *A63B 21/4019* (2015.10); *A63B 2023/006* (2013.01); *A63B 2225/105* (2013.01)

(58) Field of Classification Search

CPC ..... A63B 23/16; A63B 21/0552; A63B 21/00069; A63B 21/0428; A63B 21/023; A63B 21/05; A63B 21/4019; A63B 2023/006; A63B 2225/105

See application file for complete search history.

(56) References Cited

U.S. PATENT DOCUMENTS

| | | | | | |
|---|---|---|---|---|---|
| 1,023,756 | A * | 4/1912 | Pons | A63B 21/00043 | 482/128 |
| 2,634,976 | A * | 4/1953 | Mock | A63B 23/16 | 482/48 |
| 2,837,334 | A * | 6/1958 | Long | A63B 23/16 | 482/49 |
| 3,633,908 | A * | 1/1972 | Krauth | A63B 21/00043 | 482/126 |
| 4,290,600 | A * | 9/1981 | Kolbel | A63B 21/05 | 482/126 |
| 4,350,335 | A * | 9/1982 | Pasbrig | A63B 23/16 | 482/128 |
| 4,351,527 | A * | 9/1982 | Crisp, Jr. | A63B 21/00043 | 482/121 |

(Continued)

*Primary Examiner* — Andrew S Lo

(74) *Attorney, Agent, or Firm* — Alix, Yale & Ristas, LLP

(57) ABSTRACT

A multi-functional finger exercise device includes mechanisms for both compression exercises and extension exercises. The compression exercises are provided by a plunger biased away from a central housing. The extension exercises are provided by an elastic member with an anchor exposed from the housing. The tension provided by each of the compression mechanism and extension mechanism is adjustable.

21 Claims, 3 Drawing Sheets

(56) References Cited

U.S. PATENT DOCUMENTS 4,363,488 A * 12/1982 Maroth ..... A63B 69/3632 473/233
4,623,146 A * 11/1986 Jackson ..... A63B 21/05 482/106
5,125,878 A * 6/1992 Wingate ..... A63B 23/16 482/121
5,147,256 A * 9/1992 Silagy ..... A63B 23/16 482/128
5,167,596 A * 12/1992 Ferber ..... A63B 21/0004 482/114
5,300,003 A * 4/1994 Hull ..... A63B 21/00 482/139
5,431,611 A * 7/1995 Silagy ..... A63B 23/16 482/122
5,820,523 A * 10/1998 Zemer ..... A63B 23/16 482/49
5,913,756 A * 6/1999 Glaser ..... A63B 21/05 482/128
6,086,478 A * 7/2000 Klitsner ..... A63F 9/24 273/273
6,179,749 B1 * 1/2001 Thorn ..... A63B 21/05 482/44
6,746,373 B1 * 6/2004 Bohmer ..... A63B 21/05 434/260
7,909,697 B2 * 3/2011 Zheng ..... A63B 71/0622 273/238
7,967,732 B2 * 6/2011 D'Addario ..... A63B 21/023 482/44
8,460,102 B2 * 6/2013 Zheng ..... A63B 71/0622 273/238
8,747,286 B1 * 6/2014 Simon ..... A63B 21/05 482/128
9,750,973 B1 * 9/2017 Yang ..... A61H 3/0288
10,220,237 B2 * 3/2019 Bentley ..... A63B 21/00043
2003/0017920 A1 * 1/2003 Fazio ..... A63B 21/0004 482/112
2004/0152571 A1 * 8/2004 Udwin ..... A63B 21/00043 482/128
2006/0090630 A1 * 5/2006 Woods ..... A63B 21/023 84/465
2009/0247375 A1 * 10/2009 Smith ..... A63B 21/0004 482/110
2010/0279826 A1 * 11/2010 Weinstock ..... A63B 23/16 482/47
2011/0092346 A1 * 4/2011 Wakuda ..... A63B 21/0004 482/121
2013/0172155 A1 * 7/2013 Adamchick ..... A63B 71/0622 482/8
2016/0038793 A1 * 2/2016 Kikel ..... A63B 43/04 310/38

* cited by examiner

MULTI-FUNCTIONAL FINGER EXERCISE DEVICE

CROSS-REFERENCE TO RELATED APPLICATION

This application claims priority to U.S. Provisional Patent Application No. 62/508,410, filed May 19, 2017, the entire contents of which are hereby incorporated by reference.

BACKGROUND

The disclosed embodiments relate to finger and hand exercisers, and more particularly a finger and hand exerciser with multiple functions, including both compression and extension exercises, which thereby allow users to perform a vast array of different exercises.

U.S. Pat. No. 5,147,256 discloses a combination individual finger and entire hand exerciser. As disclosed in this patent, the exerciser includes three cooperating body members, mainly an upper body member, a centrally disposed body member and a lower body member. The body member is provided to promote individual finger exercising and includes four adjacent, individually independently slidable finger grips. The bottom body member is provided to promote entire hand exercising. Each of the finger grips is maintained in an initial clearance position from the centrally disposed body member by a helical spring which is disposed in an encircling relation about a pin which is slidable in the middle body member. Exposed caps of the upper body member are respectively provided on finger grips. A user may contact the caps with his fingers and press down on finger grips against the resistance of springs to exercise his fingers. It is noted that the tension in the exercising springs forming part of the finger grips is not adjustable by the user, and may provide too great or too little resistance for the user's individual fingers when the user is performing exercises with the finger and hand exerciser.

Another finger and hand exerciser is disclosed in U.S. Pat. No. 5,431,611 (Silagy '611). The patent discloses an exerciser where the finger plunger components that are pressed by the user are allegedly adjustable in size to accommodate the hand width and finger length dimensions of the user. This patent discloses that the finger and hand exercising device includes four resistance spring, plunger-type, finger-actuated members, each of which is attached to a base. Each finger-actuated member includes an externally threaded, height-adjusting member which is threadedly engaged with a housing and in which is received an exercise spring. Slidably disposed in relation to height-adjusting member is a tube for containing a spring. A removable cap for engagement with a user's finger is removably threaded onto tube to hold the exercising spring in place. The user may raise or lower the height of the finger-actuated members to adjust for variations in the user's finger lengths by turning threaded member in housing of each of the plungers. It should be noted from the Silagy '611 patent that the tension of the exercising springs is not individually adjustable and remains the same even as the height of the plungers is adjusted. In fact, the Silagy '611 patent teaches that the cap must be removed from tube to replace and insert an exercise spring of an appropriate construction material and helical turns or configuration to vary the exercise effort in using the device.

Still another finger exerciser is disclosed in co-owned U.S. Pat. No. 7,967,732. This patent discloses a finger and hand exerciser with a housing or base defining a plurality (typically four) chambers arranged side-by-side parallel to one another. Each chamber has a tension adjustment member in a lower portion of the chamber defined by the housing, a plunger is received and reciprocatingly slidable in an upper portion of each chamber defined by the housing, and a bias member (preferably a compression spring) extends between the plunger and the tension adjustment member in each chamber.

None of these prior art devices allows both compression and extension exercises in a single unit, and moreover allows adjustment of tension for both types of exercises. It would thus be useful to have a hand exerciser that solves these drawbacks of the prior art.

SUMMARY

An embodiment of a multi-functional finger exercise device extends between a first and second end. The first end has a compression mechanism for allowing compression exercises. The second end has an extension mechanism for allowing extension exercises. The level of tension provided by the compression mechanism and the level of tension provided by the extension mechanism are both adjustable.

In another embodiment, a multi-functional finger exercise device comprises a central housing that defines a chamber and a central axis. A threaded rod is positioned within the chamber along the central axis extending from a first end to a second end. A tension adjustment nut is threaded to the rod and exposed from an opening in the housing. A compression mechanism includes a reciprocating plunger with a portion exposed from a first end of the housing, a compression adjuster axially fixed to the rod and a bias member positioned axially between the compression adjuster and the exposed portion plunger biases the plunger away from the housing. An extension mechanism comprises an elastic line extending from a first end to a second end. The first end is fixed to the rod and the second end is fixed to an anchor member that is exposed on the second end of the housing.

In yet another embodiment of the multi-functional finger exercise device, a central housing defines a chamber and a central axis, and extends from a first end to a second end. A rod extends from a first end to a second end and is positioned along the central axis within the chamber. The device also includes a tension adjuster for moving the rod axially within the housing. A compression mechanism includes a reciprocating plunger with a portion exposed from a first end of the housing and a compression adjuster axially fixed to the first end of the rod. A spring is compressed between the compression adjuster and a surface of the plunger to bias the plunger axially away from the rod. An extension mechanism comprises an elastic line extends secured to the rod with a portion of line attached to an anchor member exposed from the second end of the housing. Axial movement of the rod in a first direction of the first end of the housing causes increased compression in the spring between the compression adjuster and the surface of the plunger and simultaneous stretching of the elastic between the rod and the anchor member.

BRIEF DESCRIPTION OF THE DRAWINGS

A preferred embodiment of the invention is described herein with reference to the accompanying drawings, in which.

DETAILED DESCRIPTION

Figure 4:
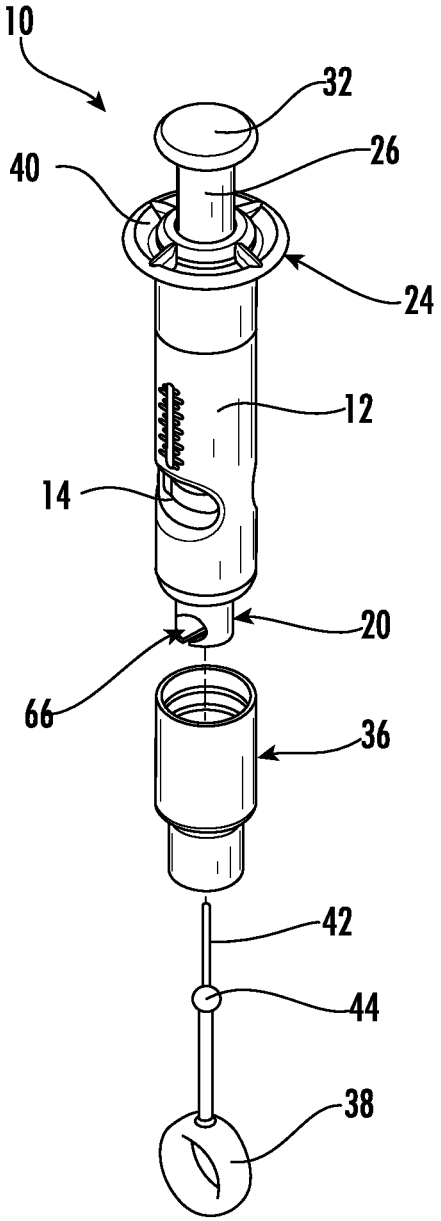
FIG. 4 shows key lower elements of the device of FIG. 1 in a partial exploded view with intermediate and upper elements assembled.

With reference to the drawings, disclosed herein is a multi-functional finger exercise device 10. The device 10 includes an elongate substantially cylindrical housing 12 defining a longitudinal axis A with a compression exercise mechanism on one end (top in the Figures) and an extension exercise mechanism on the opposite end (bottom in the Figures). The compression mechanism includes a plunger button 32 fixed atop a plunger shaft 26 that is slidingly maintained coaxial with the housing 12. In a preferred embodiment, the plunger button 32 is a malleable material that may provide enhanced friction for improving grip, such as rubber or silicon, for example. A compression cap 24 with a central opening for the shaft 26 and a circumferential flange 40 is fixed to the housing 12 intermediate the compression end of the housing and the compression cap 24. An elastically secured anchor 38, such as the depicted extension ring 38, is attached on the opposite extension end of the housing 12. As shown in the exploded view of FIG. 4, an elastic line 42 extends from the ring 38 and carries an intermediate ball latch member 44. As will be discussed in more detail below, the depicted preferred ball latch member 44 in FIG. 4 is substantially spherical in contour, however other shapes may be utilized, ideally provided that the shape allows rotation of the ring 38 about the central axis (i.e., cylindrical, conical, frustoconical). An extension cap 36 is attached at the extension end of the housing 12 axially between the housing and the ring 38. The extension cap 36 defines a pass-through opening at its bottom end (not depicted) for the elastic line 42. The pass-through opening is preferably aligned with the axis A.

As shown in FIG. 4, when the extension adjuster 20 is in a lowered low tension position, at least the cylindrical portion of the extension adjuster 20 is exposed axially from the housing 12. In this preferred embodiment, the extension cap 36 has inner threading for mating on outer thread at the extension end of the housing 12, however this is not a limiting method of attachment. Additionally, this embodiment of the extension cap 36 has a "staggered" configuration with an upper cylindrical portion 48 of a first diameter and a lower cylindrical portion 49 with a smaller second diameter. This configuration has been shown to provide enhanced stability for a user of exercise device 10 in that it provides a robust leveraging surface for a user's hand.

The housing 12 includes at least one side opening 46 that exposes an axially positioned tension adjustment nut 14. Preferably, a second side opening 46 on the opposite side of the housing 12 that exposes an opposite portion of the tension adjustment nut 14. The tension adjustment nut 14 is rotatably maintained via threaded engagement with an axial central threaded rod 16. The threaded rod 16 carries an extension adjuster 20 on the extension end and a compression adjuster 18 on the compression end. While not specifically depicted in the Figures, the threaded rod 16 may have a flat portion or similar registry surface for cooperative engagement with a surface of an appropriately shaped opening in the housing 12 to prevent the shaft from rotating with the tension adjustment nut 14 during use. The registry surface allows axial reciprocation of the shaft relative to the housing, but fixes the shaft and housing rotationally. As shown, the extension adjuster 20 has a cylindrical lower portion 62 and a frustoconical upper portion 64. The top frustoconical portion 64 is centrally threaded on its inner surface for engagement with the extension end of the rod 16. The bottom end of the cylindrical portion 62 is fit with a laterally extending slot 66 for receipt of and engagement with the ball latch member 44. As shown, the slot 66 extends laterally through the cylindrical portion with an open bottom that allows the elastic line 38 to pass through. The cooperative contour of the slot 66 and ball latch member 44 axially maintains the latch member relative to the threaded rod.

Figure 1:
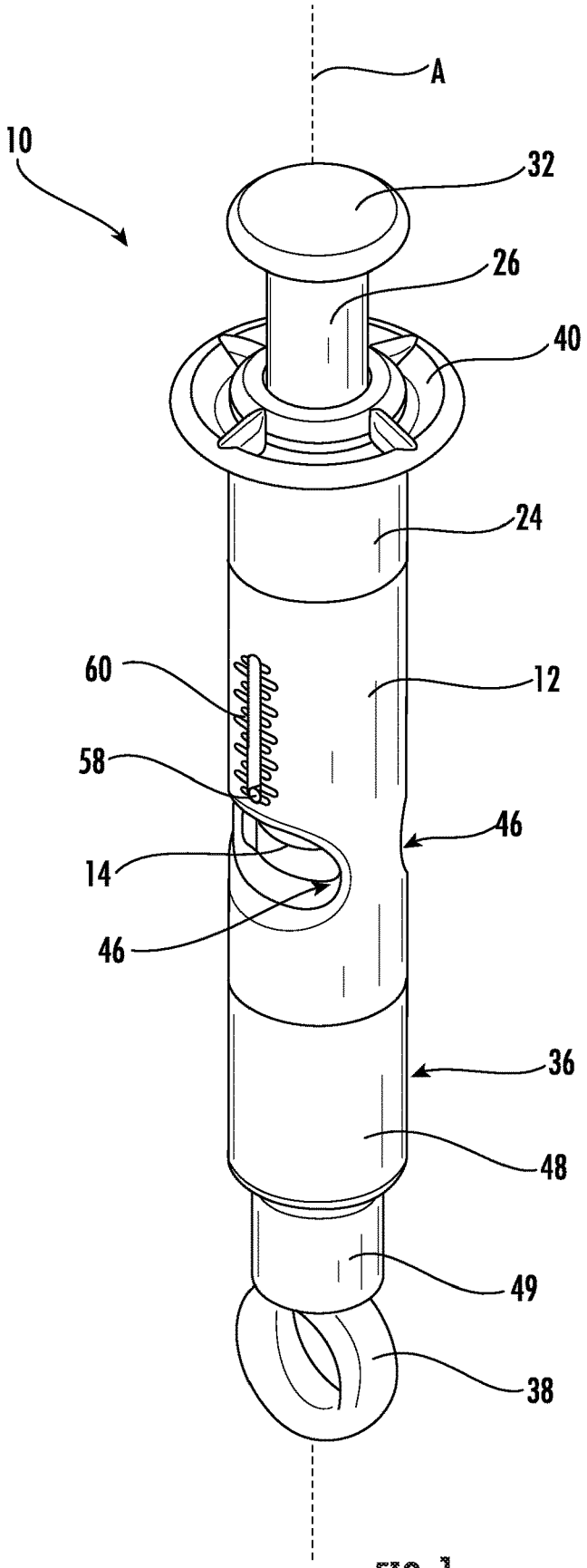
FIG. 1 shows an embodiment of the exercise device as assembled.
Figure 2:
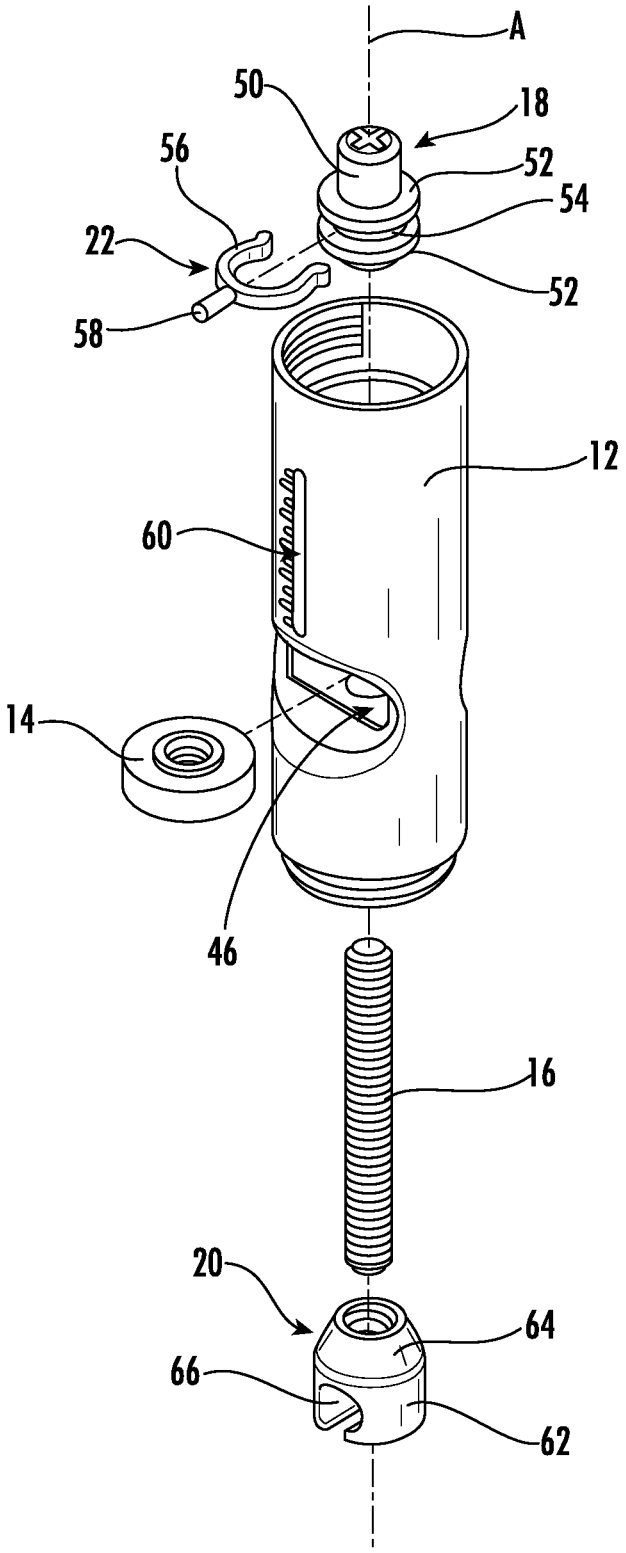
FIG. 2 is an exploded view of key intermediately located elements of the device of FIG. 1.

With reference to the exploded view of key elements shown in FIG. 2, the central threaded rod 16 is axially fixed to the extension adjuster 20 at the extension end and axially fixed to the compression adjuster 18 on the compression end. The tension indicator 22 attaches to the compression adjuster 18 with a portion of the tension indicator being viewable through the housing 12. More particularly, in this embodiment, the compression adjuster 18 comprises a top nub 50 and two circumferential flanges 52 axially spaced from each other to define a circumferential slot 54 therebetween. The slot 54 is configured to receive and maintain a snap ring 56 portion of the tension indicator 22 in an arrangement that allows axial rotation between the compression adjuster 18 and tension indicator. In the depicted embodiment, the housing 12 includes a longitudinally extending indication slot 60 intermediate the side opening 46 and the compression end. A radially extending projection 58 on the tension indicator 22 extends at least partially into the indication slot 60. In operation of the exercise device 10, the longitudinal position of the projection 58 along the slot 60 indicates the tension level to the user. Note that the tension adjustment nut 14 is threaded on the rod axially between the compression adjuster 18 (carrying the tension indicator 22) and extension adjuster 20.

In a preferred embodiment of the assembled exercise device 10, the top flange 52 abuts the bottom end of the spring 34 with the nub radially inside the spring. The connection between the tension indicator 22 and compression adjuster 18 with the ring 56 snapping into the slot 54 allows the compression adjuster 18 to rotate independent from the tension indicator 22. In the depicted embodiment, the tension indicator 22 is kept rotationally fixed relative to the housing 12 by the projection 58 extending into the indication slot 60.

Further details of the depicted embodiment of the multi-functional finger exercise device 10 will be appreciated by the following illustrative assembly instructions for the device, which serve only an exemplary purpose and are non-limiting:

A. Center Mechanism (FIG. 2):

1. Insert tension adjustment nut 14 into the side opening 46 of the center housing 12.
2. Thread the central threaded rod 16 into the nut 14 by inserting it via the extension end (bottom in the Figures) of the housing 12.
3. Snap the tension indicator 22 onto the compression adjuster 18 (i.e., snap ring 56 into circumferential slot 54).
4. Using a screwdriver or similar elongate tool, lower the attached compression adjuster 18 and tension indicator 18 through the open compression end (top in the Figures) of the housing 12 with the projection 58 aligned within the indication slot 60.
5. Thread the compression adjuster 18 onto the compression end of the threaded rod 16.

6. Screw on the extension adjuster 20 onto the extension end of the threaded rod 16.

Figure 3:
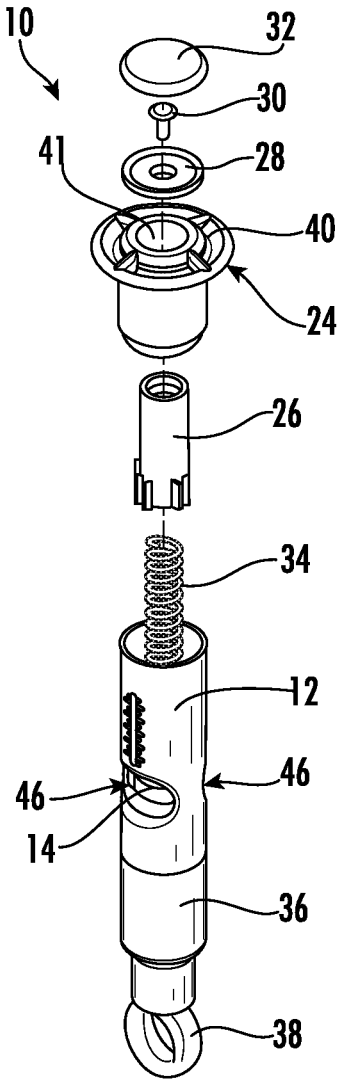
FIG. 3 shows key upper elements of the device of FIG. 1 in a partial exploded view with intermediate and lower elements assembled.

B. Compression Mechanism (FIG. 3):

1. Insert plunger shaft 26 through central opening 41 in compression cap 24.

2. Press the middle disc 28 on the top of the compression shaft 26 to trap the compression cap 24 between the plunger shaft 26 and disc 28, and secure the disc 28 via threading the top screw 30 into the plunger shaft 26.

3. Press the top button 32 onto the disc 28.

4. Place the compression spring 34 into the housing 12 abutting the top flange 52 with the nub 50 centrally aligned (see FIG. 2 for element details).

5. Attach the compression cap 24 (with attached assembly from steps B-1 through B-3 above) by threading to the compression end of the housing 12 and trapping the spring 34 axially between the compression adjuster 18 and top end of the hollow plunger shaft 26.

C. Extension Mechanism (FIG. 4):

1. Rotate the tension adjustment nut 14, to move the threaded rod 16 downward to expose the cylindrical portion 62 of the extension adjuster 36 from the housing 12.

2. Insert the elastic line 42 through the central opening of the extension cap 36.

3. Grab the inserted end of the elastic line 42 above the ball latch member 44 and pull to expose the ball latch member from the top of the extension cap 36.

4. Slide the ball latch member 44 into the laterally extending slot 66 in the extension adjuster 20, and then attach the extension cap 36 to the housing 12 via threading onto the extension end (see FIG. 2 for element details).

In use, a user can turn the tension adjustment nut 14 via the side opening 46, which causes the central threaded rod 16 to move axially (up/down). One can readily appreciate that turning the nut 14 in a first direction moves the attached compression adjuster 18 and extension adjuster 20 up (via the upward moving rod 16) to increase tension. Upward movement of the compression adjuster 18 compresses the spring 34 to increase resistance/tension on the compression plunger 26 so that more force is required to press the plunger button 32 down. On the extension end of the device 10, upward movement of the extension adjuster 20 pulls the elastic line 42 tighter, thereby increasing tension to require more force to extend the ring 38. Conversely, rotation of the tension adjustment nut 14 in the opposite direction causes the rod 16 to move downward, thereby reducing spring tension on the compression plunger 26 and relaxing the elastic line 42. It can also be appreciated that the tension indicator 22 viewable through the slot 60 rises to indicate increasing tension and lowers to indicate decreasing tension. Thus, when the indicator 22 is at the longitudinal position in the slot 60 closest to the tension adjustment nut 14, both the compression end and extension end provides the least resistance. When the indicator 22 is at the longitudinal position in the slot 60 furthest from the adjustment nut 14, both the compression end and extension end provide the most resistance.

In the preferred embodiment of the device shown in the drawings, the threaded rod 16, adjustment nut 14 and coil spring 34 are formed from metal; the elastic line is formed from an elastic polymer, such as silicone; and the remaining elements are typically formed from a moldable polymeric material, such as a thermoplastic or similar. Of course these exemplary materials are illustrative and non-limiting to the inventive concepts described herein.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A multi-functional finger exercise device comprising:

a first end with a compression mechanism for allowing compression exercises against a spring bias member;

a second end with an extension mechanism for allowing extension exercises;

a housing defining a chamber with a central axis;

a compression adjuster positioned within the chamber in operative communication with the compression mechanism for adjusting a level of tension provided by the compression mechanism; and an extension adjuster positioned within the chamber in operative communication with the extension mechanism for adjusting a level of tension provided by the extension mechanism.

2. The exercise device of claim 1, comprising a tension adjustment nut, wherein movement of the tension adjustment nut causes the level of tension provided by the compression mechanism and the level of tension provided by the extension mechanism to increase simultaneously.

3. The exercise device of claim 1, wherein the compression mechanism comprises a plunger that is reciprocable in an axial direction.

4. The exercise device of claim 1, wherein the extension mechanism comprises an elastic line attached to the device proximate the second end.

5. The exercise device of claim 1, comprising a central rod positioned coaxially within the chamber and being reciprocable along the central axis.

6. The exercise device of claim 5, comprising a tension adjustment nut aligned with the central axis and having a portion exposed from an intermediate portion of the housing for increasing and decreasing tension on the compression mechanism and extension mechanism.

7. The exercise device of claim 6, wherein the central rod is threaded and the adjustment nut is threadedly engaged thereto such that rotation of the nut in a first direction moves the rod in a first axial direction, and rotation of the nut in an opposite second direction moves the rod in a second axial direction.

8. The exercise device claim 5, wherein the compression mechanism comprises a plunger and the extension mechanism comprises an elastic line, further comprising a compressed coil spring biasing the plunger away from the housing, wherein axial movement of the rod in a first direction compresses the coil spring causing an increase in compression tension on the plunger, the elastic line is axially fixed relative to the rod, and axial movement of the rod in a second direction opposite of the first direction stretches the elastic line, thereby causing an increase in tension on the extension mechanism.

9. The exercise device of claim 5, comprising a tension indicator viewable from an outside of the housing that axially moves with the central rod.

10. The exercise device of claim 5, wherein the extension mechanism comprises an elastic line with two opposite ends, wherein a first end of the elastic line is secured relative to the rod within the housing and a second end of the elastic line carries an anchor exposed on an exterior of the housing.

11. The exercise device of claim 10, wherein the anchor is rotatable about the axis relative to the housing.

12. The exercise device of claim 5, comprising a compression adjuster attached to a first end of the rod and an extension adjuster attached to a second end of the rod.

13. The exercise device of claim 12, wherein the compression adjuster abuts a first end of a compression spring and the extension adjuster is attached to a first end of an elastic line.

14. The exercise device of claim 1, comprising:

a threaded rod extending from a first end to a second end positioned along the central axis within the chamber;

a tension adjustment nut threaded to the rod and being exposed via an opening in the housing, wherein the compression mechanism comprises a reciprocating plunger with a portion exposed from a first end of the housing, a compression adjuster axially fixed to the rod and a bias member positioned axially between the compression adjuster and the exposed portion of the plunger to bias the plunger away from the housing; and the extension mechanism comprises an elastic line extending from a first end to a second end, the first end of the elastic line being fixed to the rod and the second end of the elastic line being fixed to an anchor exposed on a second end of the housing.

15. The exercise device of claim 14, wherein rotation of the tension adjustment nut in a first rotational direction moves the rod axially in a first axial direction, causing an increase in bias on the plunger away from the housing and pulling the first end of the elastic line in the first axial direction, thereby causing an increase in tension on the elastic line.

16. The exercise device of claim 15, wherein rotation of the tension adjustment nut in a second rotational direction opposite the first rotational direction moves the rod axially in a second axial direction, causing a decrease in bias on the plunger away from the housing and relaxing the elastic line, thereby causing a decrease in tension on the elastic line.

17. The exercise device of claim 1, wherein the housing extends from a first end to a second end, comprising:

a rod extending from a first end to a second end positioned along the central axis within the chamber;

a tension adjuster for moving the rod axially within the housing;

wherein the compression mechanism comprises a reciprocating plunger with a portion exposed from a first end of the housing, a compression adjuster axially fixed to the first end of the rod and a spring compressed between the compression adjuster and a surface of the plunger to bias the plunger axially away from the rod, the extension mechanism comprises an elastic line secured to the rod with a portion of the elastic line attached to an anchor exposed from a second end of the housing, and axial movement of the rod in a first direction of the first end of the housing causes increased compression in the spring between the compression adjuster and the surface of the plunger and simultaneous stretching of the elastic line between the rod and the anchor.

18. The exercise device of claim 1, comprising a tension adjustment nut positioned within the housing chamber with a portion of the nut exposed, wherein rotation of the nut in a first direction causes the compression adjuster to compress the spring bias member, thereby causing an increase in tension in the compression mechanism, and rotation of the nut in a second direction opposite the first direction causes the compression adjuster to relax compression on the spring bias member, thereby causing a decrease in tension in the compression mechanism.

19. A multi-functional finger exercise device, comprising a first end with a compression mechanism for allowing compression exercises;

a second end with an extension mechanism for allowing extension exercises;

a central housing defining a chamber with a central axis;

a central rod positioned coaxially within the chamber and being reciprocable along the central axis; and a bias member positioned within the chamber coaxial to the rod for biasing a plunger in the compression mechanism axially away from the chamber, wherein a level of tension provided by the compression mechanism and a level of tension provided by the extension mechanism are both adjustable.

20. The exercise device of claim 19, wherein the bias member is a compressed coil spring.

21. A multi-functional finger exercise device, comprising a first end with a compression mechanism for allowing compression exercises;

a second end with an extension mechanism comprising an elastic line for allowing extension exercises;

a central housing defining a chamber with a central axis;

a central rod positioned coaxially within the chamber and being reciprocable along the central axis; wherein a level of tension provided by the compression mechanism and a level of tension provided by the extension mechanism are both adjustable, and the elastic line of the extension mechanism is axially fixed relative to the rod.

* * * * *